US012624920B2

(12) United States Patent
Adams et al.

(10) Patent No.: US 12,624,920 B2
(45) Date of Patent: May 12, 2026

(54) SINGLE ARMAMENT CONTROL UNIT

(71) Applicant: On-Point Defense Technologies LLC, Fort Walton Beach, FL (US)

(72) Inventors: Parker Wilson Adams, Clearwater, FL (US); Matthew Richard Montgomery, Lutz, FL (US)

(73) Assignee: On-Point Defense Technologies LLC, Fort Walton Beach, FL (US)

( * ) Notice: Subject to any disclaimer, the term of this patent is extended or adjusted under 35 U.S.C. 154(b) by 88 days.

(21) Appl. No.: 18/625,997

(22) Filed: Apr. 3, 2024

(65) Prior Publication Data

US 2024/0328751 A1 Oct. 3, 2024

Related U.S. Application Data

(60) Provisional application No. 63/493,831, filed on Apr. 3, 2023.

(51) Int. Cl.
*F41F 3/042* (2006.01)
*F41F 3/055* (2006.01)

(52) U.S. Cl.
CPC ..... *F41F 3/042* (2013.01); *F41F 3/055* (2013.01)

(58) Field of Classification Search
CPC ..... F41F 3/042; F41F 3/052; F41F 3/055
USPC ..... 89/1.816
See application file for complete search history.

(56) References Cited

U.S. PATENT DOCUMENTS 1,602,570 A * 10/1926 Conlon ..... F41A 17/00 89/27.11
3,135,161 A * 6/1964 Oyhus ..... F41F 3/07 89/14.6
3,710,677 A * 1/1973 Mayer ..... F41A 9/34 89/1.816
3,766,828 A * 10/1973 Cords ..... B64D 7/00 89/1.816
3,786,715 A * 1/1974 Even ..... F41A 9/14 89/1.816
3,983,785 A * 10/1976 Dissmeyer ..... F41F 3/052 89/1.819
4,363,257 A * 12/1982 Harris ..... F41A 9/20 414/137.1

(Continued)

FOREIGN PATENT DOCUMENTS

CN 112229267 A 1/2021
CN 113959256 A 1/2022
CN 217764672 U 11/2022

OTHER PUBLICATIONS

Inspector General Department of Defense, "Modifications to the Tube-Launched, Optically Tracked, Wire-Command Missile Launcher for the Bradley Fighting Vehicle System," Report No. 98-165, Jun. 25, 1998, 33 pages.
International Search Report and Written Opinion issued for PCT/US2024/022848 dated Jan. 7, 2026, 11 pages.

*Primary Examiner* — Troy Chambers
*Assistant Examiner* — Benjamin S Gomberg
(74) *Attorney, Agent, or Firm* — Lewis Rice LLC

(57) ABSTRACT

A Single Armament Control Unit (SACU) that operates a single missile tube as opposed to multiple tubes. The SACU provides for interlock pin and umbilical depression from the housing on the rotation of a single crankshaft controlled by a single motor where the rotor of the motor and the rotational axis of the crankshaft are generally parallel to the missile tube.

20 Claims, 13 Drawing Sheets

(56) References Cited

U.S. PATENT DOCUMENTS

| | | | | | |
|---|---|---|---|---|---|
| 4,372,212 | A * | 2/1983 | Hoelzen | F42C 15/40 | 102/379 |
| 4,429,611 | A * | 2/1984 | Oldham | F41F 3/06 | 89/1.819 |
| 4,475,436 | A * | 10/1984 | Campbell | F41A 9/27 | 89/1.804 |
| 4,660,456 | A * | 4/1987 | Griffin | F41F 3/06 | 89/1.819 |
| 7,086,318 | B1 | 8/2006 | Darnall | | |
| 7,513,187 | B1 * | 4/2009 | Lambermont | F41A 27/14 | 89/37.02 |
| 10,066,892 | B1 | 9/2018 | Dacier et al. | | |
| 10,145,639 | B2 * | 12/2018 | Lung | F41A 27/18 | |

* cited by examiner

SINGLE ARMAMENT CONTROL UNIT

CROSS-REFERENCE TO RELATED APPLICATIONS

This application claims the benefit of U.S. Provisional Patent Application No. 63/493,831, filed on Apr. 3, 2023, the entire disclosure of which is herein incorporated by reference.

BACKGROUND

1. Field of the Invention

This disclosure is related to the field of arming control systems for missile launchers, and more particularly to an arming system which is primarily designed to interconnect with a single TOW missile tube.

2. Description of the Related Art

Produced since 1970, the TOW ("Tube-launched, Optically tracked, Wire-guided") missile is one of the most utilized guided anti-tank missiles in the world. The concept of the weapon is relatively straight-forward. The missile is mounted inside a dedicated launch tube which is aimed at the target. Aiming is typically accomplished by a human operator utilizing a Target Acquisition System (TAS) which provides some form of a visual sight either relying on daylight or infrared (IR) night-vision. When triggered, the missile leaves the launch tube and is propelled toward the target. Originally, the missile would trail guiding wires through which communication information could be sent from the launcher to the missile. More modern versions, however, can now use wireless signals in the same way.

An infrared (IR) beacon in the missile's tail is located by the TAS and provided to a Flight Control Subsystem (FCS) which allows the location of the missile to be tracked during flight and that allows for the flight to be adjusted based on the position of the reticle in the aiming system. The reticle is maintained on the target during the missile's flight by the operator and this steers the missile. Feedback between the operator's positioning of the reticle and the detected position of the missile is transmitted via the wires or wireless connection to flight surfaces of the missile to allow it to be directed into the target identified by the reticle positioning. Specifically, that it will impact the point indicated by the operator as the target.

TOW missiles are very versatile with one of the key aspects of their value and pervasiveness being their ability to be launched from a variety of platforms and carry a variety of warheads. These include where the missile is launched by infantry from a modular tripod mount that breaks down into a number of components, to use on secondary mounts for vehicles, to use on dedicated armored vehicles designed to utilize TOW missiles as their primary armament. While these systems all ultimately utilize the same missiles, it is important to recognize that their support systems and missile launchers are often quite different.

In a vehicle mount, the operator will typically want to be inside the vehicle so as to be protected by its armor (under armor) as this is, in many respects, the point of utilizing an armored vehicle at all. This separates the operator (as well as any others using the vehicle) from the missile itself. This is positive from a defensive point-of-view, but can result in problems related to the use of a missile.

Part of the flexibility of TOW missiles is that are typically provided in a tube or other container prior to use. This tube is then designed to be placed within a launcher assembly which includes all the electronics to aim, fire, and guide the missile during flight. Because the missile comes pre-packaged in the tube, interconnection of the launcher with the tube can utilize generally common electrical interconnection components and the human interface elements of the TOW operation (e.g. the aiming using the reticle) are similar regardless of missile type. In effect, the TOW missile tube makes the system somewhat modular and allows for an operator to use a first kind of missile from their launcher, eject the spent tube from the launcher, and install and fire an entirely different kind of TOW missile without substantially altering their interaction with the targeting and aiming.

FIG. 1 provides an image of a prior art launcher assembly (100) for use on a vehicle such as a Bradley fighting vehicle. In FIG. 1, the launcher (100) has been removed from its exterior housing. This launcher (100) will typically be mounted on a turret or similar structure. As should be apparent from FIG. 1, the launcher assembly (100) comprises two cradles (101) and (102) which are used to support the missiles in their tubes. Two cradles (101) and (102) are not required but are near ubiquitous as the system has typically been constructed to provide either two or four missiles (two launchers) depending on battlefield role. Further, as the launcher (100) was constructed to be durable and repeatedly reusable, it has become a default standard simply through long use.

Single tube launchers have traditionally been limited to systems which are directly fired by infantry, such as through a tripod mount or on a ring turret, where the user is exposed and (at least partially) outside the vehicle. The two cradles (101) and (102) in the launcher (100) are interconnected with each other (traditionally having been cast and/or machined together) and, because of this arrangement, the launcher (100) has typically utilized a common Armament Control Unit (called a DACU (200) herein) for the tubes in both cradles (101) and (102). The DACU (200) performs a variety of functions related to connecting the missile in the tube either to the launcher assembly (100) but ultimately to the Vehicle Control Unit (VCU) or other Target Acquisition System (TAS) inside the vehicle which is used to target and fire the missile.

The DACUs (200) primary function is to provide mechanical interconnection of data cables from the VCU to an interconnection on the missile tube which data cables then serve to provide electrical connection from the VCU to the missile itself. This electrical communication provides for the data loop between the VCU and missile to allow the missile to be fired and guided. To put it simply, the DACU (200) primarily connects the electrical cable from the VCU to the missile and does so in a way that is repeatable and certain. This inhibits damage to the missile tube or launcher (100) during this interconnection. The cable being interconnected to provide electrical control of the missile to the VCU typically actually provides interconnection of the umbilical cable on the missile which is connected to a connector on the tube, to an umbilical connector in the DACU (200), which is then electrically connected via a cable to the VCU.

While this electrical connection of the umbilical is the primary purpose of the DACU (200), the DACU (200) also carries out tasks related to this interconnection which are primarily designed to inhibit this interconnection from being performed in a manner which could damage the ability of the launcher (100) to be interconnected with this or a later used missile tube, and to inhibit the ejection of a spent tube from similarly resulting in damage which could inhibit interconnection with a later tube. In all these cases, the DACU (200) effectively acts to "arm" the missile which has been located in the cradle (101) or (102) to take it from the position where it was transported to the vehicle to one where the vehicle will be firing it.

Traditionally, once missile tubes were placed in the cradles (101) and (102), the operator had to manually interconnect and arm the missile by manually interconnecting the umbilical connector and other connectors. This is still generally the case in the tripod mount infantry version of the launcher. However, in an armored vehicle, manual interconnection can be problematic. Specifically, in time sensitive situations or in hazardous conditions, manual arming could result in difficulty and danger. To deal with this, motorized DACUs (200) were introduced. These assisted with the interconnection to deal to improve consistency of the interconnection and to not expose the operator outside the vehicle during arming. They also provided that the arming interconnection was more repeatable. However, these systems had a problem of being specifically designed to operate on the existing dual cradle launchers (100). As such, they would always arm both missiles in both cradles (101) and (102) simultaneously. That is, the system mechanically interconnected and armed both missiles together and was traditionally designed to only work with two missile systems with the missiles arranged side-by-side in a co-planar arrangement.

SUMMARY

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Because of these and other problems in the art, there is described herein, among other things, is a Single Armament Control Unit (SACU) that operates a single missile tube as opposed to multiple tubes. The SACU provides for interlock pin and umbilical depression from the housing on the rotation of a single crankshaft controlled by a single motor where the rotor of the motor and the rotational axis of the crankshaft are generally parallel to the missile tube.

Described herein, among other things, is a Single Arming Control Unit (SACU) for a missile cradle, the SACU comprising: a housing; a motor in the housing; and a crankshaft in the housing including at least two cranks, wherein: a first crank of the at least two cranks is arranged in a first plane through an axis of rotation of the crankshaft; a second crank of the at least two cranks is arranged in a second plane through the axis of rotation of the crankshaft; the first crank is connected to an interlock pin for a missile tube in the missile cradle; the second crank is connected to an umbilical connector for the missile tube in the missile cradle; and the second plane and first plane are not parallel; wherein, the motor acts to rotate the crankshaft between a first safe position and a second armed position.

In an embodiment, the SACU further comprises: a safety arm and a safety pin; wherein when the motor rotates the crankshaft from the safe position to the armed position the motor also causes the safety arm to extend the safety pin from the housing.

In an embodiment of the SACU, a rotor of the motor is arranged generally parallel with the axis of the crankshaft.

In an embodiment of the SACU, the rotor of the motor is arranged generally parallel with the safety arm.

In an embodiment of the SACU, the rotor of the motor is arranged generally parallel to the missile tube.

In an embodiment of the SACU, the first plane is positioned relative the second plane so that the interlock pin extends from the housing before the umbilical connector extends from the housing when the crankshaft rotates from the first safe position to the second armed position.

In an embodiment of the SACU, the missile tube includes a TOW missile.

In an embodiment of the SACU, the missile cradle is arranged parallel to a second missile cradle.

In an embodiment of the SACU, the missile cradle is arranged coplanar to the second missile cradle.

In an embodiment of the SACU, the rotor of the motor is arranged generally parallel with the axis of the crankshaft.

In an embodiment of the SACU, the rotor of the motor is arranged generally parallel to the missile tube.

In an embodiment, the SACU further comprises: a circuit board electrically interconnected to the umbilical connector for sending signals to the missile tube; and a connector for electrically interconnecting the circuit board to a Vehicle Control Unit (VCU) so the circuit board receives signals from the VCU.

In an embodiment of the SACU, the circuit board includes a portion for sending signals to a splice cable electrically interconnected with a second umbilical connector.

There is also described herein, in an embodiment, an arming system for multiple missile tubes, the arming system comprising: a first Single Arming Control Unit (SACU) for a first missile cradle, the first SACU comprising: a first housing; a circuit board in the first housing; a first motor in the first housing; and a first crankshaft in the first housing including at least two cranks, wherein: a first crank of the at least two cranks is arranged in a first plane through an axis of rotation of the first crankshaft; a second crank of the at least two cranks is arranged in a second plane through the axis of rotation of the first crankshaft; the first crank is connected to an interlock pin for a first missile tube in the first missile cradle; the second crank is connected to an umbilical connector for the first missile tube in the first missile cradle; and the second plane and first plane are not parallel; wherein, the first motor acts to rotate the first crankshaft between a first safe position and a second armed position; and a second SACU for a missile cradle, the second SACU comprising: a second housing; a second motor in the second housing; and a second crankshaft in the second housing including at least two cranks, wherein: a first crank of the at least two cranks is arranged in a first plane through an axis of rotation of the second crankshaft; a second crank of the at least two cranks is arranged in a second plane through the axis of rotation of the second crankshaft; the first crank is connected to an interlock pin for a second missile tube in the second missile cradle; the second crank is connected to an umbilical connector for the second missile tube in the second missile cradle; and the second plane and first plane are not parallel; wherein, the second motor acts to rotate the second crankshaft between a first safe position and a second armed position; wherein the circuit board electrically controls both the first motor and the second motor.

In an embodiment of the arming system, the rotor of the first motor is arranged generally parallel with the axis of the first crankshaft.

In an embodiment, the arming system further comprises: a first safety arm and a first safety pin; wherein when the first motor rotates the first crankshaft from the safe position to the armed position the first motor also causes the first safety arm to extend the first safety pin from the housing.

In an embodiment, the arming system further comprises: a second safety arm and a second safety pin; wherein when the second motor rotates the first crankshaft from the safe position to the armed position the second motor also causes the second safety arm to extend the second safety pin from the housing.

In an embodiment of the arming system, the first motor and the second motor move in tandem.

In an embodiment of the arming system, in both the first SACU and the second SACU the first plane is positioned relative the second plane so that the interlock pin extends from the housing before the umbilical connector extends from the housing when the crankshaft rotates from the first safe position to the second armed position.

In an embodiment of the arming system, the missile cradle is arranged coplanar to the second missile cradle.

BRIEF DESCRIPTION OF THE DRAWINGS

In FIG. 6 the lower portion of the housing of the SACU is removed.

DESCRIPTION OF THE PREFERRED EMBODIMENT(S)

Figure 1:
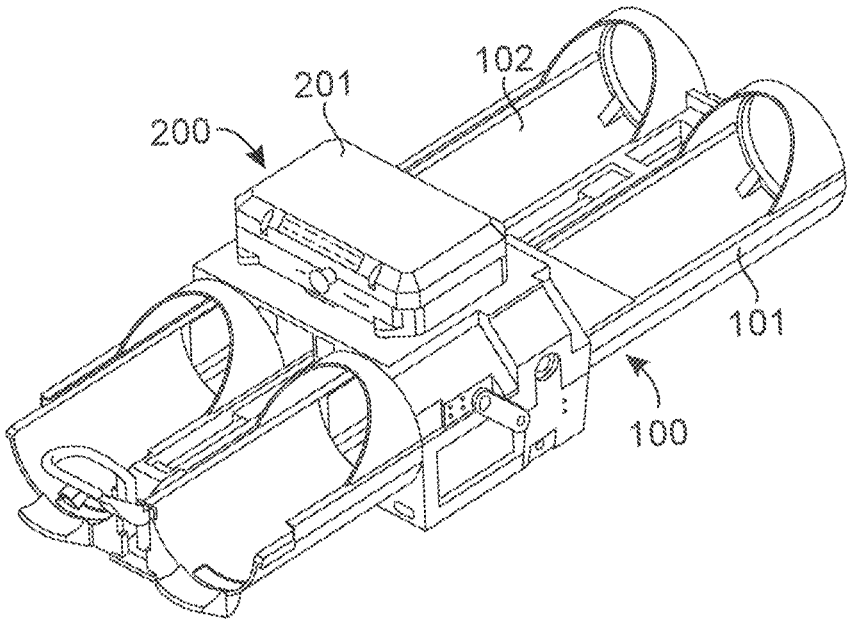
FIG. 1 (Prior Art)
FIG. 1 Comprises a TOW missile launcher assembly removed from the external housing of the prior art.

The following detailed description and disclosure illustrates by way of example and not by way of limitation. This description will clearly enable one skilled in the art to make and use the disclosed systems and methods, and describes several embodiments, adaptations, variations, alternatives and uses of the disclosed systems and methods. As various changes could be made in the above constructions without departing from the scope of the disclosures, it is intended that all matters contained in the description or shown in the accompanying drawings shall be interpreted as illustrative and not in a limiting sense.

This disclosure relates generally to an improved armament control unit (ACU) that provides simplified mounting and attachment interfaces, a minimized footprint to enhance availability applications, and improved operator safety and efficiency The ACU discussed herein is typically designed to operate a single missile tube as opposed to multiple tubes. For this reason, embodiments herein will typically be described as a Single Armament Control Unit or SACU which is contrasted with a conventional Dual Armament Control Unit (DACU) which operates on two side-by-side and co-planar oriented tubes simultaneously. However, it should be recognized that both an SACU and a DACU are variants of the more generic ACU and in an embodiment multiple SACUs as contemplated herein may operate together behaving as a single unit to control multiple missile tubes.

The missile launch systems associated with the SACUs discussed herein may be of a wide variety of configurations and mounted on armed vehicles of various sizes and configurations (including, but not limited to, ground-based vehicles and helicopters), may be intended for infantry use, or may be used in still alternative settings or arrangements. Since a single SACU provides for single missile control but multiple may be used in larger control arrangements, the SACU will provide for improved flexibility of missile arrangements compared to a traditional dual missile DACU. It is thus envisioned that, within the scope of the present invention, the SACU, associated assemblies, and methods of using the same may have multiple applications, weapons-related and beyond.

Conventional human-actuated armament control units—even single armament control units—can leave operators exposed to external threats. Manipulating and/or actuating the units further sacrifices valuable time for arming, a luxury oftentimes not available in time-sensitive or battle situations. Various embodiments of the present invention not only provide an improved ACU in the form of a SACU, but also one that is motorized in a unique manner, so as to provide a solution to the inherent tactical drawbacks of human actuated ACUs. Still further, various embodiments of the present invention mechanically and electrically mimic key connectivity aspects of existing DACUs, thereby significantly reducing manufacturing and logistical costs when retrofitting existing vehicles or the like with the present embodiments.

Figure 2:
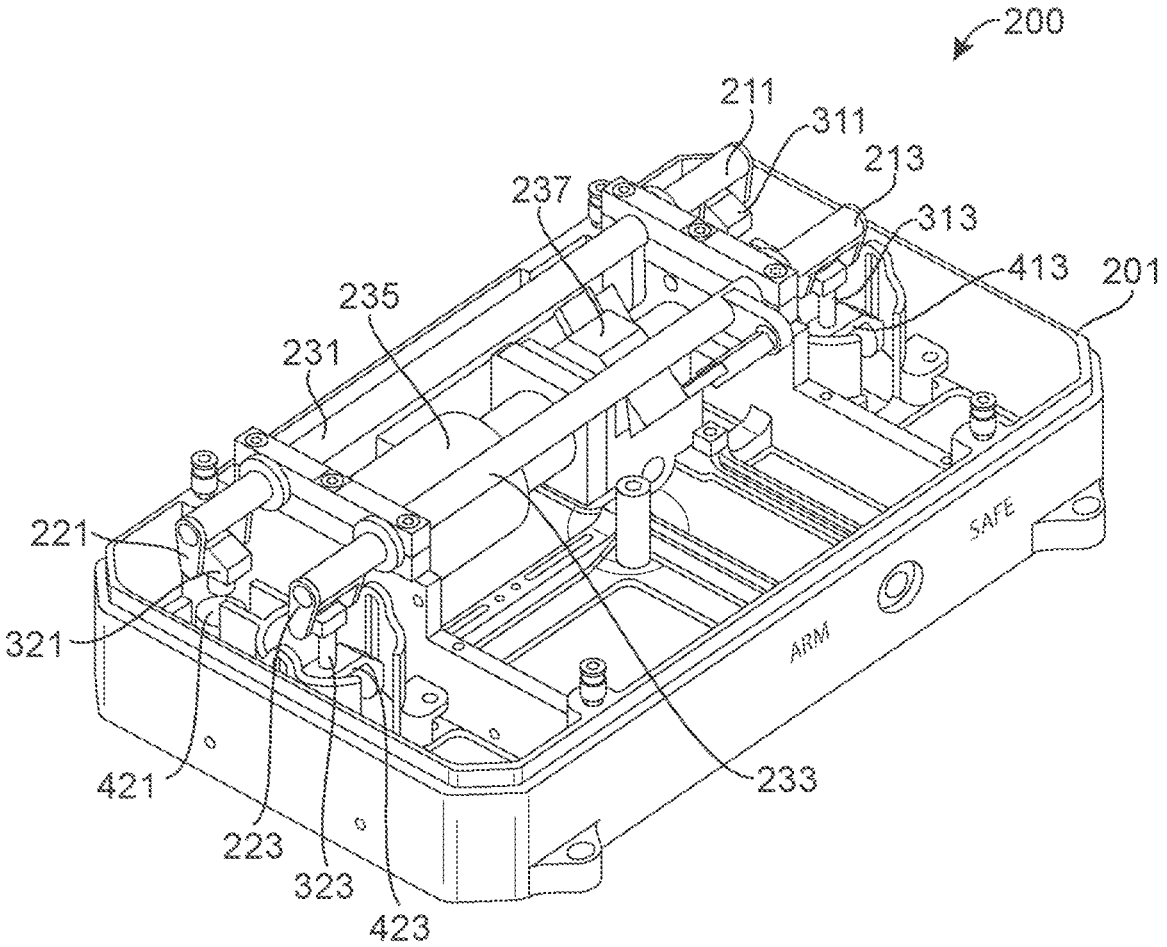
FIG. 2 (Prior Art)
FIG. 2 Shows a motorized Dual Armament Control Unit (DACU) with its housing partially removed. This is a system which is designed to arm missiles in both cradles in a two cradle launcher simultaneously.
Figure 3:
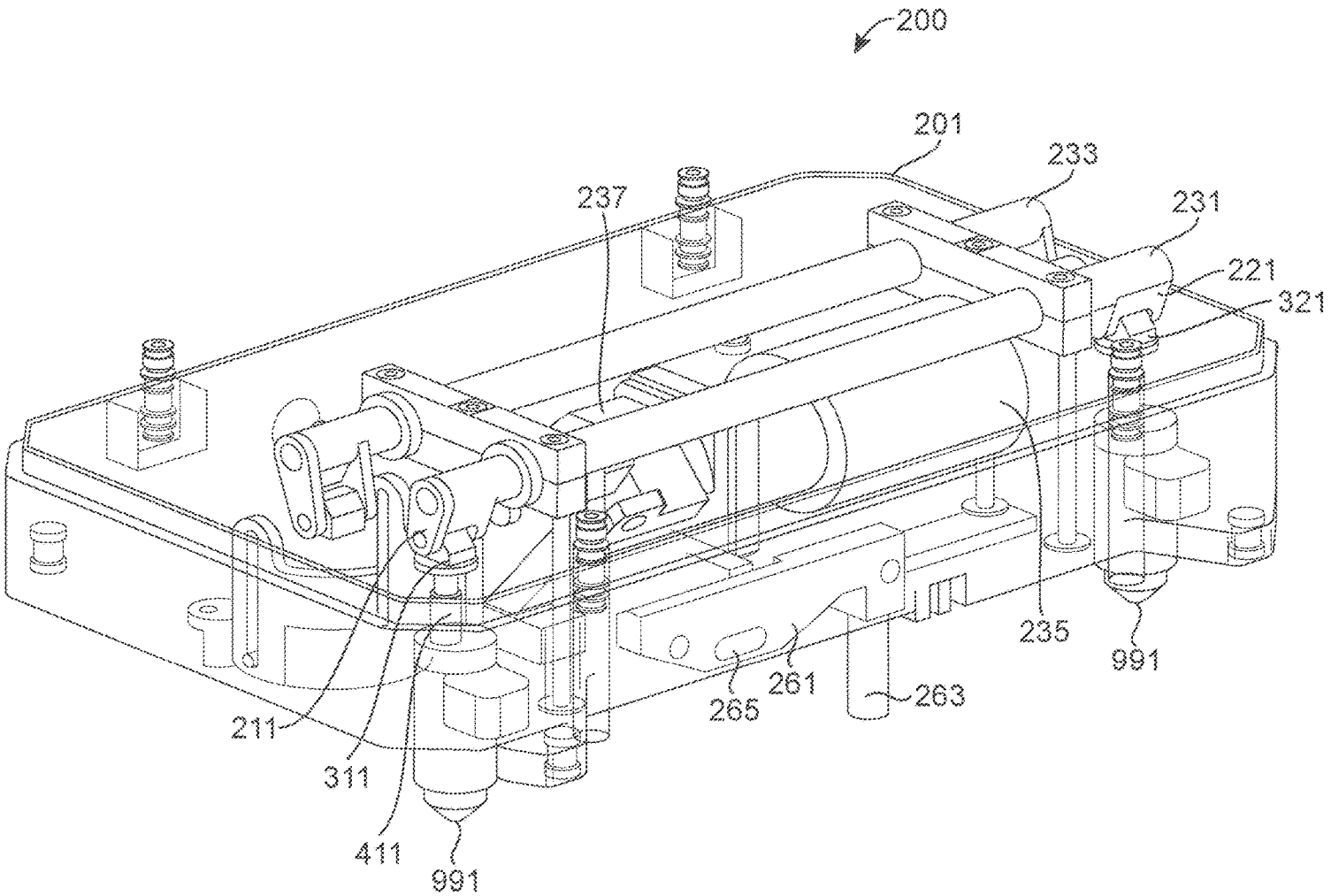
FIG. 3 (Prior Art)
FIG. 3 Shows a view of FIG. 2 from the opposing side and with the housing in ghost form.

FIGS. 2 and 3 illustrate an exemplary embodiment of a conventional or legacy DACU (200) configured for a dual tube missile arrangement such as that used with the launcher (100) of FIG. 1. FIG. 2 shows the DACU (200) of FIG. 1 with the housing (201) partially removed while in FIG. 3 the housing (201) is both partially removed and shown in ghost form so that certain components are better visible. The housing (201) comprises an internal volume into which are placed two shafts (231) and (233) coupled mechanically to transmission (237) which is coupled to a motor (235) whose rotor is placed generally in parallel with shafts (231) and (233). The housing (201) and, thus the DACU, is sized and shaped to span both cradles (101) and (102) of the launcher (100) as shown in FIG. 1.

The longitudinal (rotational) axes of the motor (235) and shafts (231) and (233) are oriented substantially perpendicular to the longitudinal axes of associated cradles (101) and (103), which are generally parallel and co-planar with each other, upon which the DACU is mounted. On both ends of the shaft (231) are cranks (211) and (221). The shafts (231) and (233) serve to convert rotational motion into linear motion. Specifically, rotation of the shaft (231) is converted into linear motion via the piston arms (311) and (321) which respectively raise or depress the interlock pins (411) and (421) associated with each cradle (101) and (102). The crank (211) serves to act on the interlock pin (411) which will correspond to a missile tube placed in the cradle (101) while the crank (221) serves to act on the interlock pin (421) which will correspond to a missile tube placed in the cradle (102). Similarly, the cranks (213) and (223) serve to convert rotational motion of the shaft (233) into linear motion and raise or depress the umbilical connectors (413) and (423) via the pistons (313) and (323). Crank (213) serves to act on the umbilical connector (413) which will correspond to a missile tube placed in the cradle (101) while the crank (223) serves to act on the umbilical connector (423) which will correspond to a missile tube placed in the cradle (102).

In an embodiment, the mechanical connectivity between the shafts (231) and (233) and the motor (235) will typically be constructed such that only a 90-degree rotation is provided to the various cranks (211), (213), (221) and (223). This facilitates shifting of the DACU (200) from armed to safe mode (and vice versa) quickly and consistently.

As is best visible in FIG. 3, the DACU also includes a safety lever (261). The safety lever (261) is coupled to safety pin (263) which is shown extending below the housing (201) in FIG. 3. In this position, the safety pin (263) would act to inhibit missile tubes in the cradles (101) and (102) from being removed or unlocked via a manual handle. In the embodiment of FIG. 3, the handle operates on tubes in both cradles (101) and (102) simultaneously to lock the tubes in place. Therefore, there is only a single interlock pin (263). The safety lever (261) and safety pin (263) is raised and lowered by interaction with the transmission (237).

As opposed to the DACU of FIGS. 2 and 3, FIGS. 4, 5, and 6 provide various views of an exemplary embodiment of a motorized SACU (500). As compared to the DACU (200), the motorized SACU (500), when a single unit is used alone, is designed to interact with only a single cradle (102) or (101) and associated missile tube as opposed to operating on tubes in both cradles (101) and (102) simultaneously. This can allow for the SACU (500) to be used with a launcher which only has one cradle without lost capacity.

Figure 4:
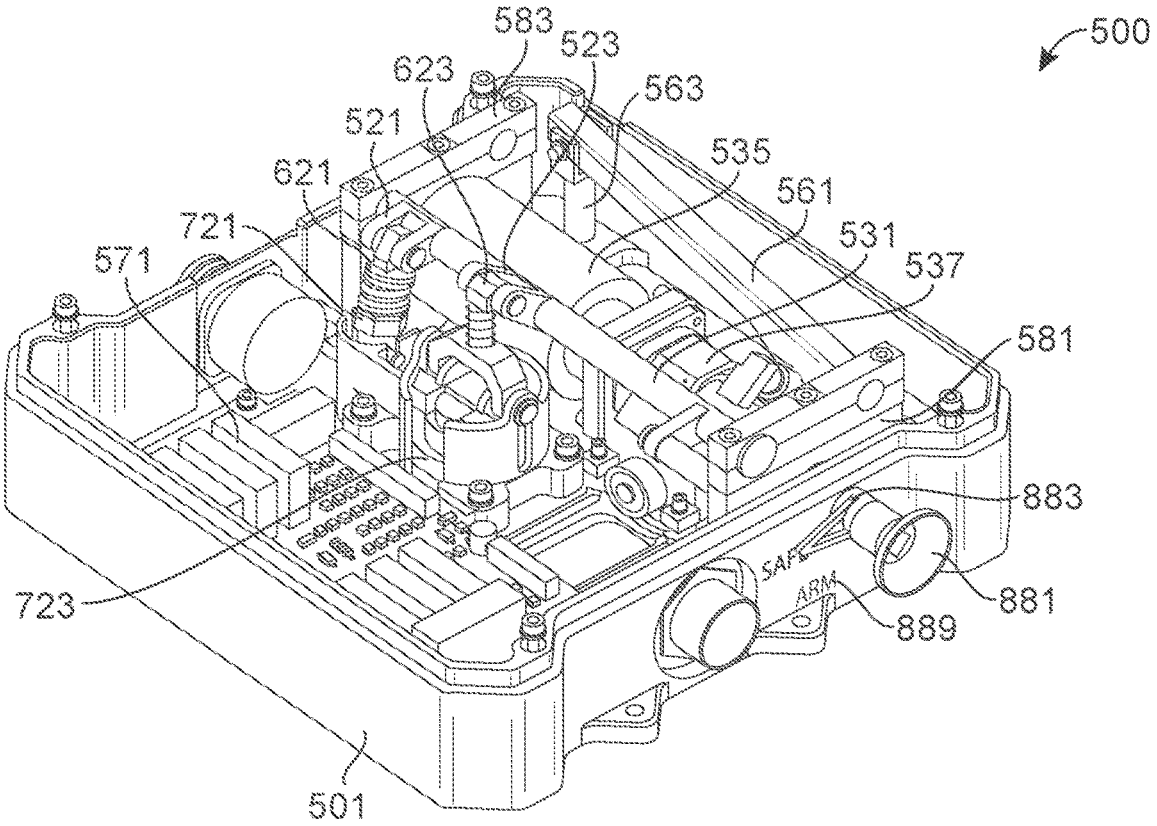
FIG. 4 shows a perspective view from a front left corner of a motorized SACU which serves to activate and arm a single missile. The top portion of the housing of the SACU is removed in FIG. 4
Figure 5:
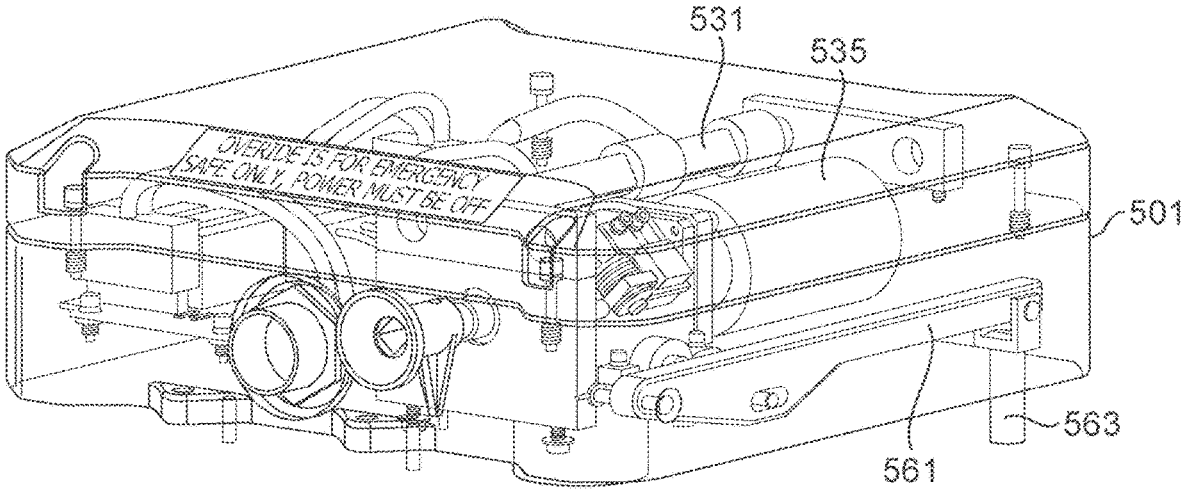
FIG. 5 shows a perspective view of the SACU of FIG. 4 from the front right corner with the entire housing in ghost form.

As can be best seen in FIGS. 4 and 5, the SACU (500) still has a housing (501) but it is typically substantially smaller than the housing (201). Like the housing (201), the housing (501) may be arranged to be formed of two separable halves. In FIG. 4 the upper half is removed and in FIG. 6, the lower half is removed. The housing (501) will typically have about half the footprint of the housing (201) but will often have a similar height. Further, the SACU (500) only has a single crankshaft (531) which includes two cranks (521) and (523) each of which, via a piston (621) or (623) engages either the interlock pin (721) or the umbilical connector (723) of a single missile. This is as opposed to the DACU (200) of FIGS. 2 and 3 where the individual shaft (231) engages the interlock pins (421) and (411) and a different shaft (233) engages the umbilicals (423) and (413) of both missiles.

Figure 7:
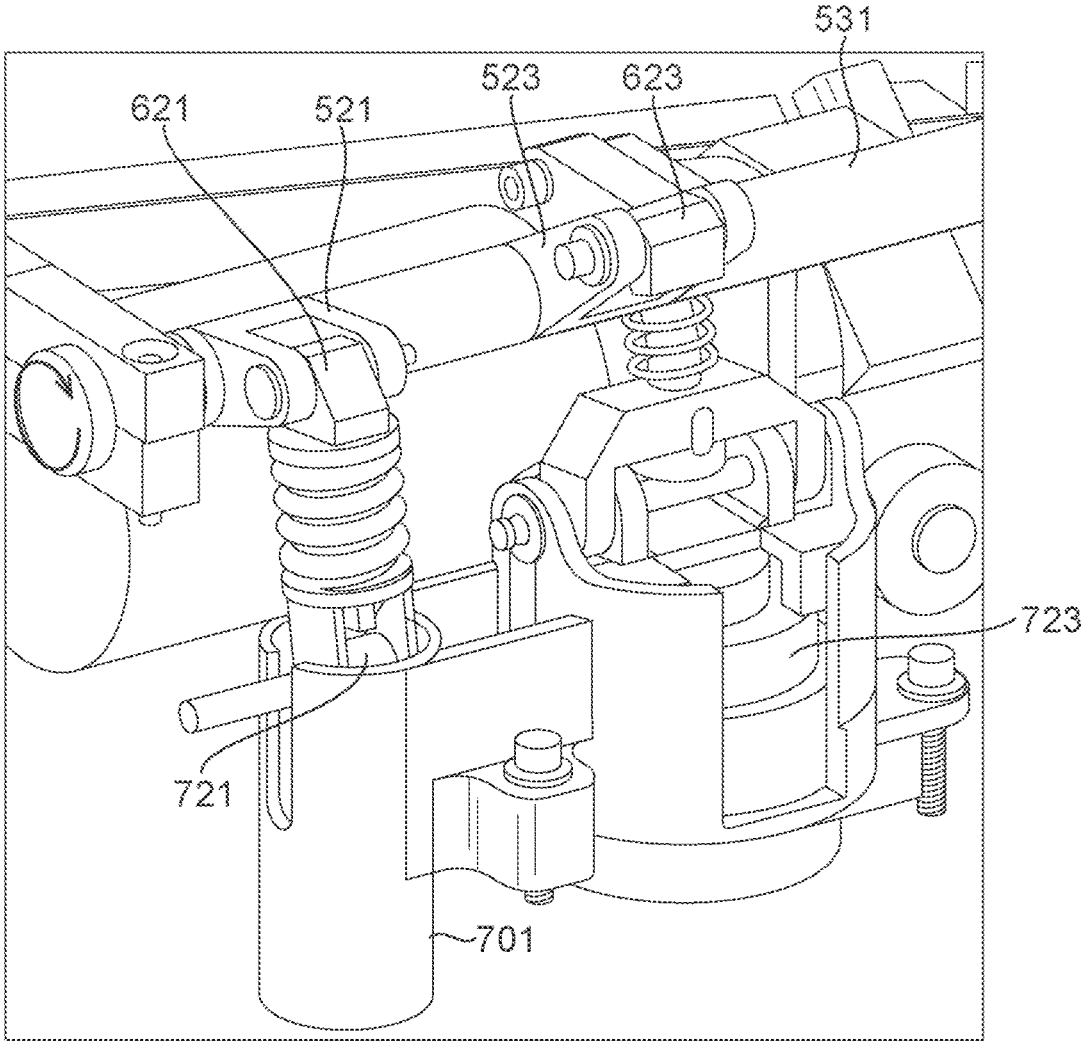
FIG. 7 shows a detail view of the interlock pin and umbilical connectors and associated components from the SACU of FIG. 4.

The crankshaft (531) interconnection is shown in increased detail in FIG. 7. As can be seen in FIG. 7, the umbilical connector (723) is mounted to the associated crank (523) by the plunger (623) while the interlock pin (721) is attached to the crank (521) by the plunger (621). The crank (523) is oriented at a slightly higher angle than the crank (521) and is in a different plane than that of crank (521). This ensures that, as rotation of the crankshaft (531) occurs (which would be clockwise as indicated in FIG. 7) to depress the plungers (621) and (623), the engagement of the umbilical (723) with the launcher (100) is offset from that of the interlock pin (721). Specifically, the interlock pin (721) will lower first and would be at a position lower than that of the umbilical connector (723) when depression commences.

In the embodiment of the DACU (200) in FIG. 2, the shaft (231) would typically be positioned so that the interlock pins (421) and (411) would lower first compared to the shaft (233). This offset in lowering is typically performed to improve connection accuracy. Specifically, the interlock pins (421), (411), and (721) will typically terminate in a generally conical or generally hemispherical end (991). These are designed to interface and enter a corresponding void in the corresponding missile tube in the associated cradle (101) or (102). Because of the shape of the base (991) of the interlock pins (421), (411), and (721), the base (991) will only enter the void if it is closely aligned with the void. However, the shape of the base (991) allows for some play. If the base (991) is sufficiently misaligned with the void, the base (991) will simply miss the void and the structure of the tube will inhibit depression of the interlock pin (421), (411), or (721). The resistance from this inhibition will be detectable by the motor (235) or (535) which will typically result in a returned error indicating that the missile tube is not correctly positioned in the cradle (101) or (102). In an embodiment, an individual SACU (500) operating on only one specific tube could allow an indication of which cradle (101) or (102) includes the misaligned tube while in the DACU (200) of FIGS. 2 and 3 it could not distinguish if either or both tubes has a problem.

If the base (991) is basically aligned with the corresponding void, but they are offset by a small amount, lowering of the pin (411), (421), or (721) will result in the base (991) pushing against the walls of the void which will typically cause the associated missile tube to move into accurate alignment as the interlock pin (411), (421) or (721) depresses. In the embodiments of both the DACU (200) and SACU (500), once the interlock pins (411), (421), or (721) have been sufficiently depressed, the missile tubes are known to be correctly aligned in the cradles (101) and (102) with the SACU (500) or DACU (200). By having the interlock pins (411), (421) or (721) depress first, the alignment of the tubes are verified before the umbilical connectors (413), (423) or (723), which require interconnection of a number of male and female pin connectors, contact their mating connectors.

Because of the self-aligning nature of the base (991) and void, it is known that the umbilical connectors (413), (423), and (723) (which are trailing the interlock pins (411), (421), and (721)) are correctly aligned to the missile tubes prior to the umbilical connects (413), (423) and (723) leaving the housing (201) or (501) and the depression of the umbilical connectors (413), (423) and (723) is much less likely to damage the interlocking pin connectors due to misalignment. It also will typically result in a solid and correct connection. Depression of the interlock pin (721) can also serve to "unlock" the missile within the tube. Specifically, in an embodiment, the interlock pin (721) will depress an internal lock in the tube which will alter the force with which the missile is held in the tube. For example, the interlock pin (721) may move a locking mechanism to align weak points.

Thus, depression of the interlock pin (721) may also ready the missile for launch as opposed to transport.

In the SACU (500) of FIG. 4, the adjustment of the tube via the interlock pin (721) base (991) is preserved because of the offset cranks (521) and (523). Thus, even though the cranks (521) and (523) are arranged to extend from the side of the shaft (531) (as opposed to the ends with shafts (231) and (233)), since the cranks (521) and (523) are mounted on different planes through the central axis of the shaft (531), the interlock pin (721) will lower toward the tube before the umbilical connector (723). The interlock pin (721) can, therefore, act to adjust the position of the missile tube in the same fashion as occurs for the DACU in FIG. 2 even with the cranks (521) and (523) being located on the same shaft (531).

Specifically, because the umbilical connector (723), is mounted on a crank (523) which is on a different higher plane, the umbilical (723) will only lower to connect after the interlock pin (721) has effectively moved the missile tube to the necessary position or indicated an error if that is not possible. As opposed to the DACU (200) of FIG. 2, the umbilical connector (723) and interlock pin (721) are not pushed forward and backward relative to the launcher (100) but are pushed side-to-side. However, the amount of this displacement (converting rotational motion into linear motion) is often less allowing the plungers (621) and (623) to move more straight up and down than the plungers (321), (323), (311), and (313). There is still typically included a plunger housing (701) as best seen in FIG. 7 which serves to help the umbilical connector (723) and interlock pin (721) to only move linearly up and down.

Figure 6:
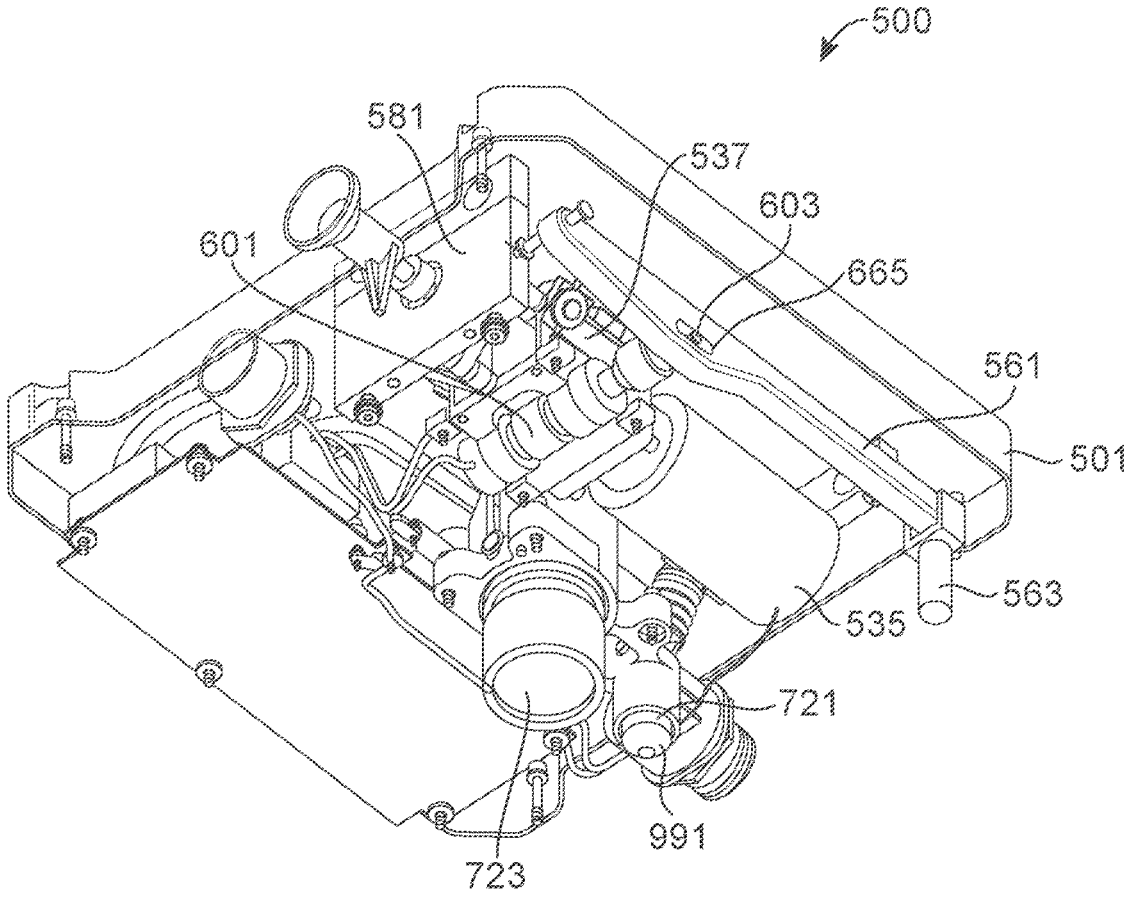
FIG. 6 shows a perspective view from the underside of the SACU of FIG. 4.

As can be best seen in FIGS. 5 and 6, the SACU (500) also includes a safety arm (561) and a safety pin (563). This has actually been removed in FIG. 8 As indicated, there will typically be a release handle on the launcher (100) to help lock the missile tube(s) in position and/or to help eject a spent or unused tube. The safety pin (563) acts to inhibit damage to the umbilical connector (723) should this release arm be utilized before the SACU (500) is disengaged from the missile tube. Specifically, should the umbilical connector (723) (and, thus, also the interlock pin (721) as indicated above) be engaged, attempts to eject or remove the missile tube from the cradle (101) or (102) may be inhibited somewhat by the interlock pin (721) being engaged with the missile tube. However, this is typically not a sufficiently strong connection to inhibit damage from an attempted removal. The safety pin (563), however, is designed to drop in the way of the motion of the release handle on the launcher (100) so that any attempt to release the missile tube when the umbilical connector (723) is still connected is strongly inhibited. Thus, damage from attempting to eject the missile tube while the umbilical (723) is still connected is greatly reduced.

In the embodiment of FIGS. 4-7 it is generally intended that in operation the crankshaft (531) will lower both the interlock pin (721) and umbilical connector (723) in the same operation of the motor (535) and at the same time that the motor operation serves to lower the safety pin (563) to inhibit removal of the missile tube. This interconnected motion of all three connections (721), (723), and (563) allows for a single motor (535) rotation to effectively move all three connectors (721), (723), and (563) at once. While this provides for some redundancy in safety, the different purposes of the three components is preserved in operation. Specifically, connection of the umbilical connector (723) primarily serves to actually arm and interconnect the missile to a TAS (such as a vehicle control unit (VCU)). As the umbilical connector (723) enables communication between the missile tube and ultimately the missile itself with the VCU, this connection is the essential connection to allow the missile to be used as intended. However, this connection is also the most sensitive and the most subject to damage as it is an electrical connection utilizing multiple connection points to transmit data and damage to any portion could result in failure of the missile to work as intended. Thus, before one engages the umbilical connector (723), one preferably wants to make sure that the connection will be correctly made.

As discussed above, alignment of the umbilical connector (723) to the tube before connection is where the interlock pin (721) comes in. In effect, the interlock pin (721) serves to verify that the connection of the umbilical connector (723) to its mating connector on the missile tube is not attempted unless the missile tube is correctly positioned so that the umbilical connector (723) connection will be successful. In this way, the interconnection with the umbilical connector (723) is inhibited if attempted interconnection could result in damage at the point of connection. While not typical in modern launchers and tubes, the interlock pin (721) previously was used to provide for a couple other points of benefit. Specifically, in certain legacy systems it could allow detection if no missile tube is placed in a particular cradle (101) or (102) (for example if only a single tube is mounted in the launcher) by detecting the lack of a missile tube due to their being no void to interact with. Interlock pins (721) have also previously be used to indicate the type of missile tube present with such information communicated via the interlock pin (761). While this type of information is typically no longer provided via the interlock pin (721) and is instead provided via the umbilical connector (723), an embodiment of a SACU (500) could be designed to utilize an interlock pin (721) to provide this information if so desired.

Thus, while the interlock pin (761) acts to help align the missile tube prior to connection to avoid damage to the umbilical connector (723), it is often not strong enough to inhibit an attempt to disconnect the missile tube before disconnection of the umbilical connector (723). This is where the safety pin (563) comes in. As a simple example, once a missile has been fired, the umbilical connector (723) will generally receive no information as the missile should have exploded, the umbilical is no longer connected with the now exploded missile, and components of the tube may have been damaged or destroyed by the launch of the missile. Similarly, any switches or other items sending information from the tube to the interlock pin (721) may also no longer be present or function. Thus, in an embodiment, a cradle (102) or (101) with a spent missile tube may resemble and electrically behave like a cradle (102) or (101) with no missile tube present. However, the cradle (101) or (102) will still include the spent missile tube which will typically want to be ejected and disposed of so a new missile tube can be placed in the launcher (100). However, attempting to remove the spent tube with the umbilical connector (723) still attached presents an additional point of potential damage to the umbilical connector (723) and the umbilical connector (723) and interlock pin (721) may not provide any feedback indicating if they are still connected or not.

The safety arm (561) and safety pin (563) act to inhibit removal of the spent tube until the umbilical connector (723) has been disconnected inhibiting damage from this action. Thus, the SACU (500) acts to connect the umbilical connector (723) while damage is inhibited from the first connection of the interlock pin (721), and inhibit damage to the umbilical connector (723) via the safety pin (563) from failure to disconnect the umbilical connector (723) before ejecting the missile tube from the launcher (100).

Figure 8:
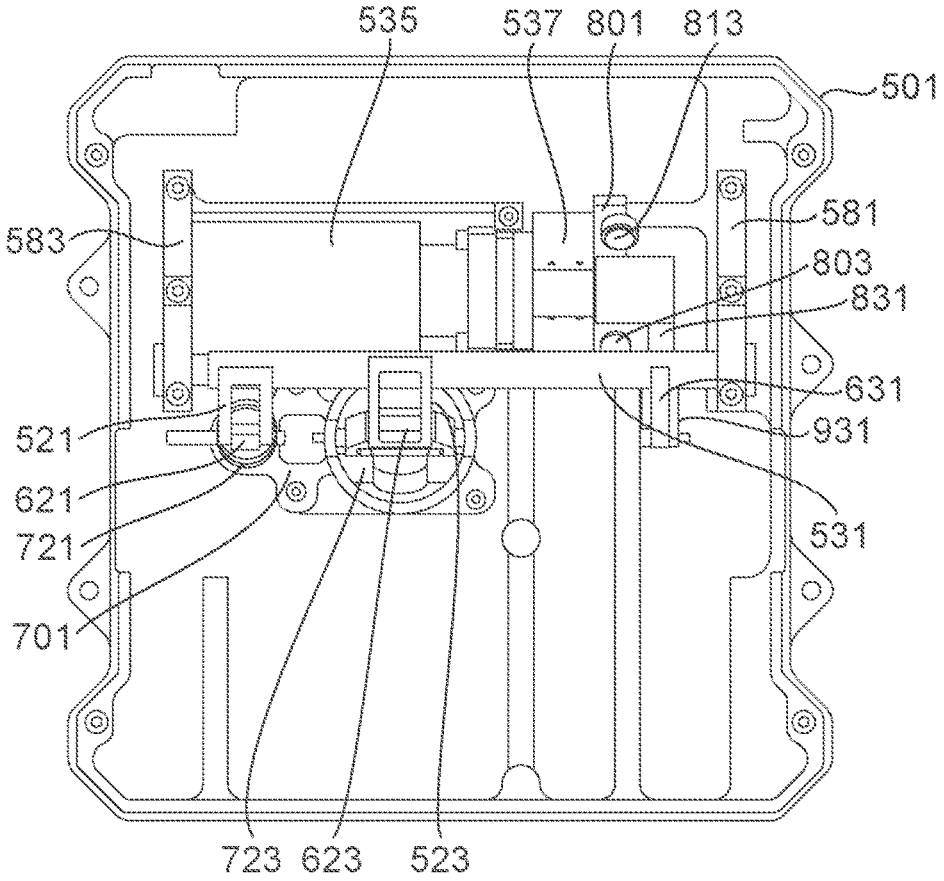
FIG. 8 shows a top view of the SACU of FIG. 4 with the safety arm removed to better show connection of the motor transmission with the crankshaft.

As should be apparent from FIGS. 4-7, Driving all of these elements is a single motor (535). The motor (535), as can be best seen in FIGS. 4 and 8 is positioned so as to generally have its rotor (545) arranged generally parallel to the shaft (531) and the safety arm (561). This allows for the motor (535) to be readily positioned within the housing (501) between the shaft (531) and the safety arm (561) and generally parallel to the orientations of the cradles (101) and (102) and missile tubes. However, to translate the motion to both the shaft (521) and safety arm (561) the rotor (545) has attached thereto a motor transmission (537) interconnecting between the motor (535), the shaft (531), and the safety arm (561). As discussed above the motion of both the safety arm (561) and the shaft (531) is interlinked and they will typically move together.

Figure 9:
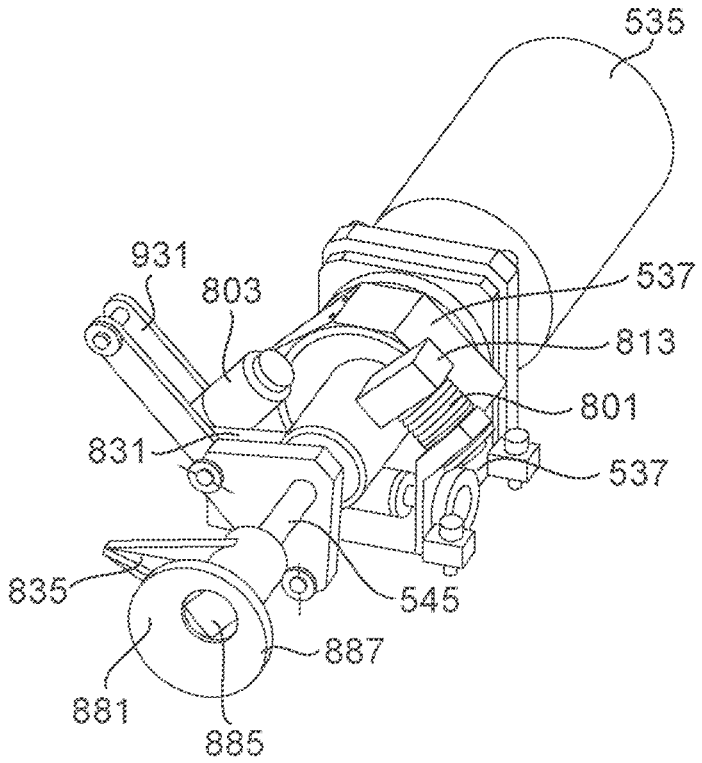
FIG. 9 shows the motor and motor, transmission, and related components of the embodiment of FIG. 4 separated from the other components.
Figure 10:
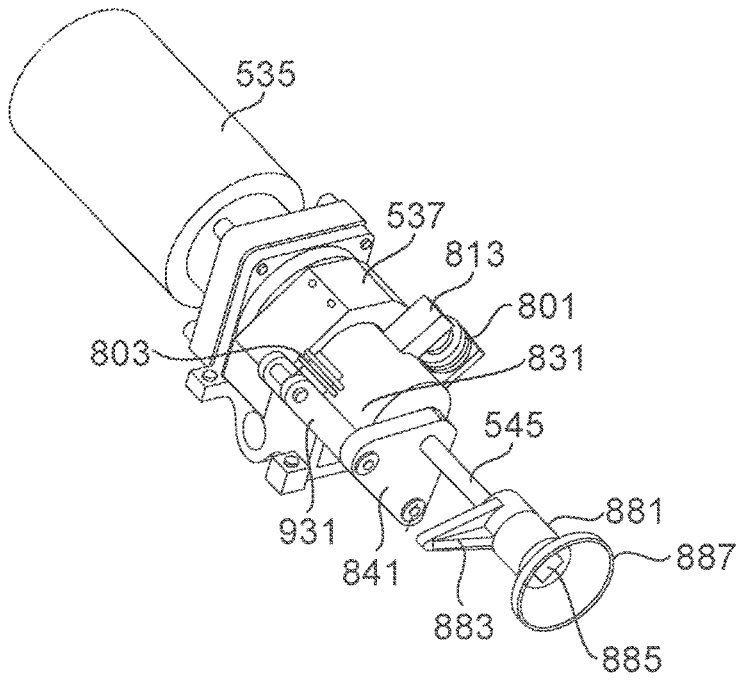
FIG. 10 shows an alternative view of the components of FIG. 6.

FIG. 8 shows a top view of the motor (535) and the attached motor transmission (537) in the housing (501) with the safety arm (561) and other components removed but with the shaft (531) and attached components present. This can assist in visualizing the interconnection of the motor transmission (537) to the shaft (531) as well as the limit switches (801) and (803). As the rotor (545) of the motor (535) is generally parallel to the main axis of the shaft (531) and parallel with the main axis of the cradles (101) and (102), the transmission (537) will serve to translate the rotational motion of the motor (535) to the shaft (531). FIGS. 9 and 10 show the motor (535) and the components associated with the rotor (545) separated from the other elements of the SACU to assist in visualizing relationships there.

The transmission (537) comprises three main components. On the underside of the transmission as can be best seen in FIG. 6 there is, in an embodiment, a series of gear teeth or other elements that will intermesh with corresponding gear teeth on a gear set (601) which ultimately causes a carrier arm (603) to slide in the racetrack shaped hole (665) in the safety arm (561). The hole (665) is similar to hole (265) in the embodiment of FIG. 2. This causes the safety arm (561) to move up and down depending on the position of the carrier arm (603) in the racetrack hole (665). The safety arm (561) will thus interconnect with the motor (535) in the same way that the safety arm (261) interacts with the motor (235).

Toward the first side of the transmission (537) there is a crank (831). The crank (831) is, in turn, connected to a transmission lever (931) which is then connected to the shaft (531) by another crank (631). Rotation of the transmission (537) causes the crank (831) to rotate, which then pulls on the transmission lever (931) via rotational connection which pulls on the crank (631) via another rotational connection causing the shaft (531) to rotate. The rotation of the shaft (531), as discussed above, causes the cranks (521) and (523), to move which serves to raise and depress the umbilical connector (723) and interlock pin (721). The shaft (531) rotation is also supported by the bearing plates (581) and (583) which also serve to support the rotation of the rotor (545).

Typically, on a generally opposing side of the transmission (537) to the crank (831), there is a locator block (813). The locator block (813) is used to detect the location of the transmission (537). Specifically, if it is in a position corresponding to the umbilical connector (723), interlock pin (721), and safety pin (561) being engaged with the missile tube ("armed" position) or if it is in a position corresponding to the umbilical connector (723), interlock pin (721), and safety pin (561) being disconnected from the missile tube (unarmed or "safe" position). The position in the rotation is determined by interaction of the locator block (813) with two limit switches (801) and (803). The first switch (801), when activated because it is in contact with the locator block (813), indicates that the motor (535) is in its extreme point of clockwise rotation (as viewed from the end of the rotor (545) looking at the motor (535)). This will correspond to the "safe" position as it corresponds to the position where the umbilical connector (723), interlock pin (721), and safety pin (563) are all retracted meaning they are disconnected from the missile tube and other associated components. This is the position of the motor (535) in FIGS. 4 and 7-9. In this position the missile cannot be fired by the TAS of the vehicle.

The other switch (803), however, is located at the extreme position of the motor's (535) counterclockwise rotation (from the same vantage as above). Activation of this switch (803) indicates that the umbilical connector (723), interlock pin (721), and safety pin (563) are all in their depressed position connected to the missile tube which corresponds to the "armed" arrangement of the system (when the missile is ready to fire). This is the position shown in FIGS. 5, 6, 12, and 13. It should be recognized that the switches (801) and (803) correspond to the maximum allowed rotation of the motor (535) so the rotor (545) will typically only move through an about 90 degree arc. The switch (801) and (803) will also typically be hard mounted to the housing (501) to inhibit the transmission (537) (and thus the rotor (545)) from moving outside of these bounds.

As indicated, the motor (535) is typically not allowed to fully rotate the rotor (545) through a 360 degree rotation. Instead, it is only allowed to rotate the rotor (545) through a portion of a complete rotation which, in the depicted embodiment, is generally about a 90 degree arc. This limitation is, however, by no means required and other arc lengths may be used in alternative embodiments including full rotations. Instead, this use of a partial arc length is simply to shorten the motion of the motor (535) between the two positions corresponding to switches (801) and (803) as well as to allow the transmission (537) to raise and lower the umbilical pin (723), interlock pin (721), and safety pin (563) an appropriate and fixed amount to correctly interface the umbilical connector (723) with the missile tube.

Attached beyond the transmission (537) and further along the rotor (545) from the motor (535) is a reinforcing connector (841). This simply serves to give additional bracing to the lever arm (931) to assist in it both transcribing the desired motion (and, thus, repeatably rotating the shaft (531) the correct amount) and to inhibit any excess or unintended motion so that the umbilical (723) and interlock pin (721) are accurately raised and lowered a correct vertical amount. The reinforcing connector (841) may also, in an embodiment, serve to assist or supply interconnection of the transmission arm to the safety arm (561).

The rotor (545) will typically terminate in a manual rotation element (881). This may comprise an indicator (883) along with a mechanical connector (885) for interconnection with a tool and/or a manual handle (887). The indicator (883) typically shows the location of the rotor (545) and, thus, can be used as a mechanical indicator if the associated missile is in a safe or armed condition based on a dial (889). In the event of electrical failure on the vehicle mounting the launcher (100), the indicator (883) and dial (889) can be used to determine if the missile tube is at a heightened danger to occupants or not. Further, the mechanical connector (885) or handle (887) may be used to manually turn the rotor (545) to any point in its rotation (e.g. with the locator block (813) in contact with the switch (803) or (801) or any point between).

The mechanical connector (885) and handle (887) are not typically intended to be used when the motor (535) is functional as the motor (535) would resist their use. However, in the event that the motor (535) loses power or is damaged, it can allow a user to arm, or more typically, safe, a missile which is in the launcher (100) by connecting or disconnecting the umbilical connector (723) without using the motor (535). As the mechanical connector (885) and/or handle (887) acts directly on the rotor (545), manually rotating the rotor (545) will cause the same movement as if the motor (535) was used resulting in similar operation to that discussed above, but under more manual control.

Figure 11:
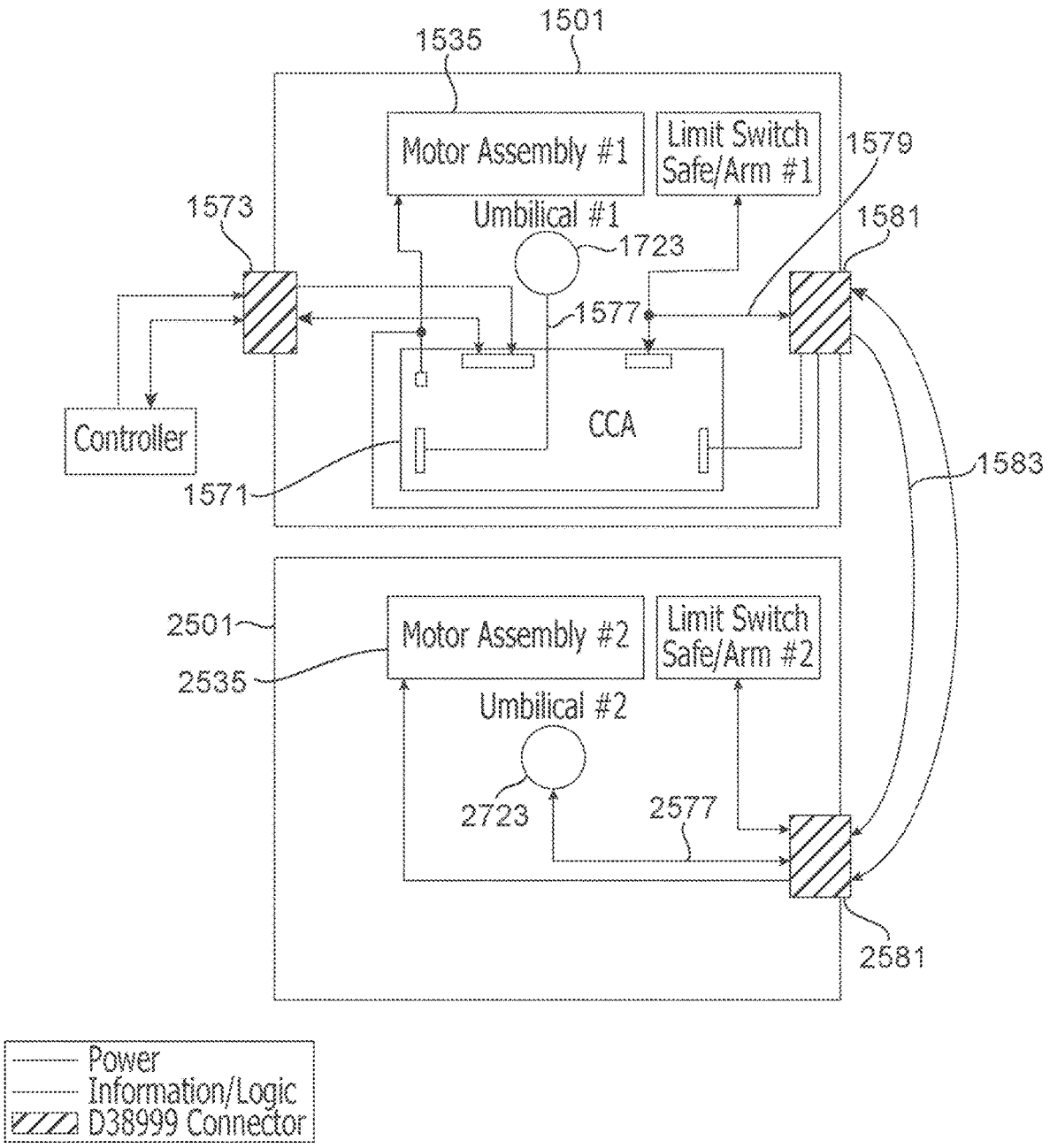
FIG. 11 shows a block diagram of the functionality of two SACUs arranged in a parent/child configuration. This can be used to operate both tubes of a dual cradle launcher together or individually. Alternatively, it may be used in dual cradle launchers of alternative configurations, or on a series of single cradle launchers.
Figure 12:
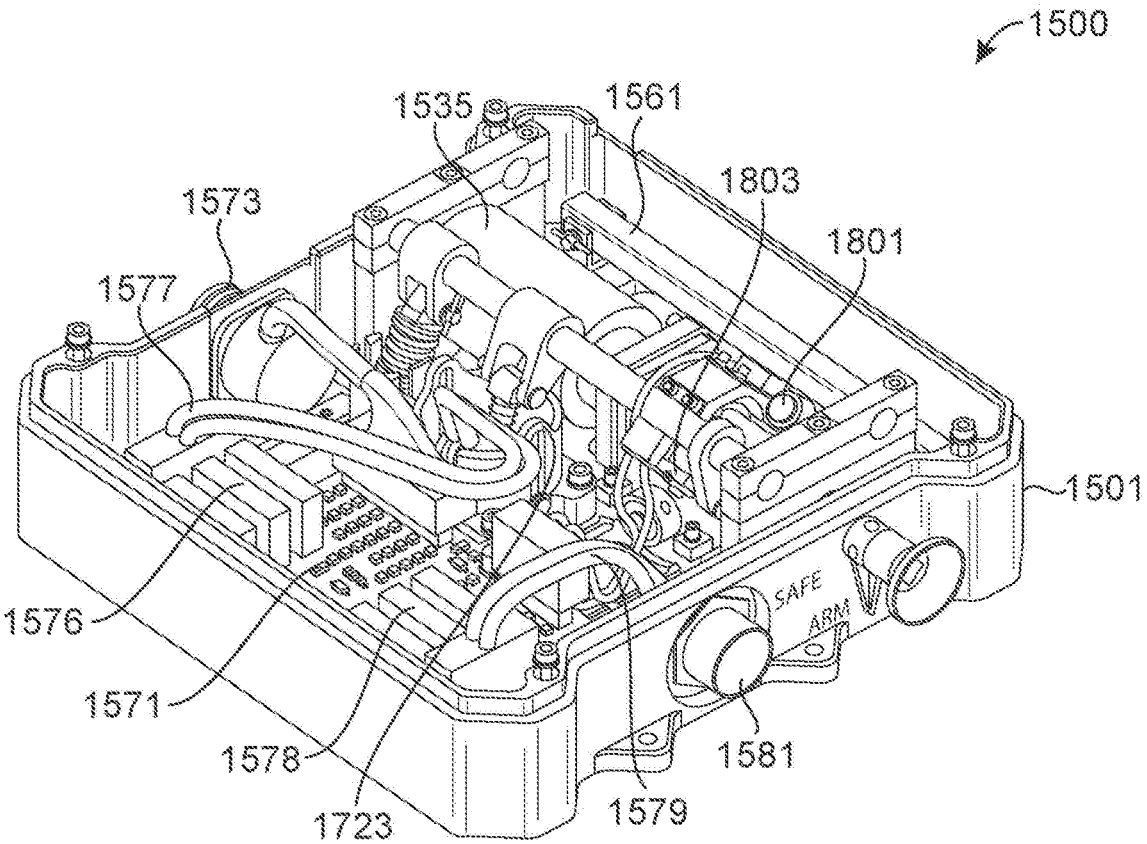
FIG. 12 shows a parent configured SACU with the top portion of the housing removed.
Figure 13:
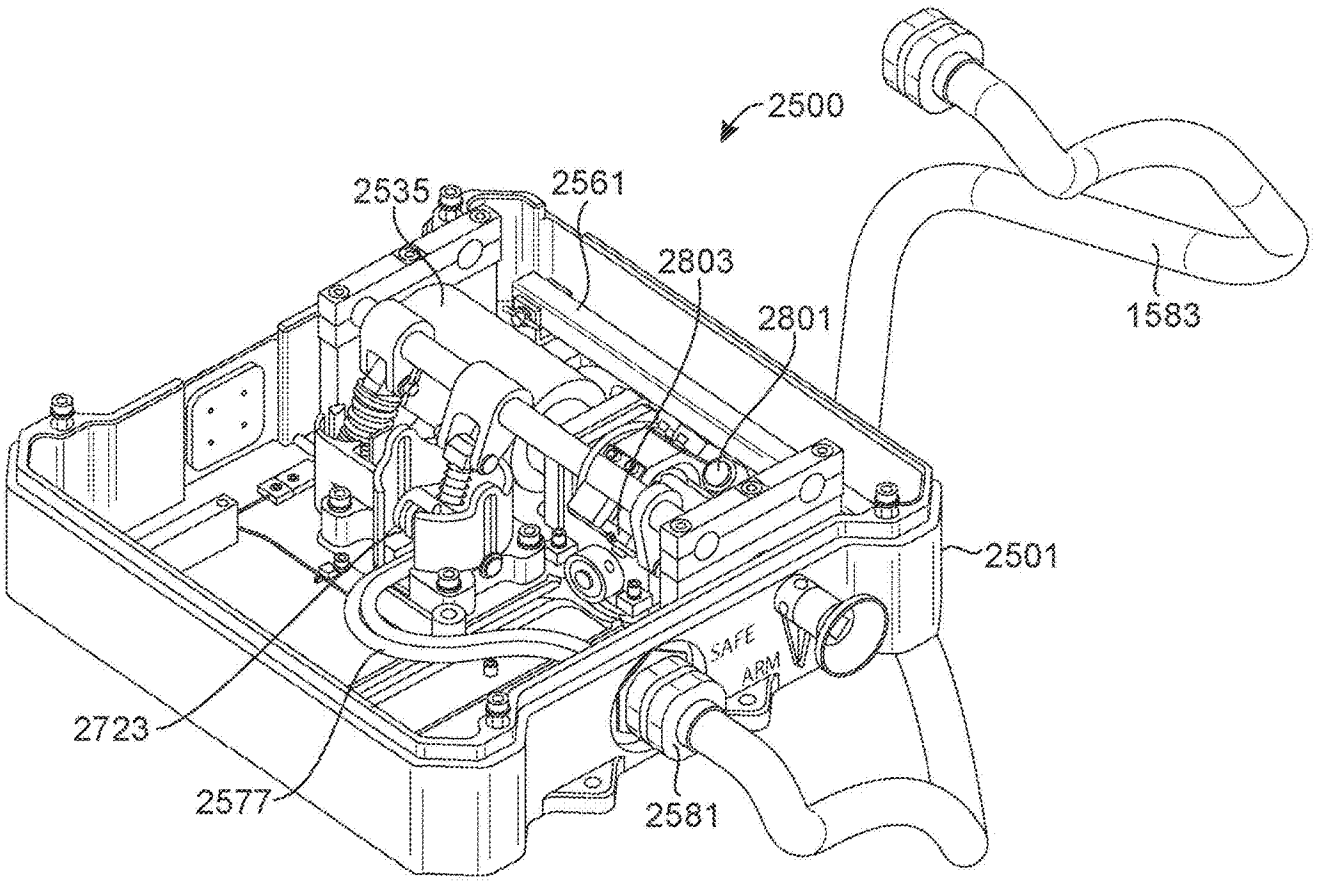
FIG. 13 shows a child configured SACU with the top portion of the housing removed.

As discussed above, the SACU (500) of FIG. 4 is generally designed to control a single missile tube. FIGS. 11-13 provide an indication of how multiple SACUs (500) may be linked together, typically in a parent/child relationship but that is not required, to behave as a single unit and operate on a multiple missile launchers. In effect, arrangements such as those shown in FIGS. 11-13 can allow multiple SACUs (500) to behave as a single (or even multiple) DACU. Further, because the SACU (500) is more modular, interconnection can allow for multiple SACUs (500) to provide additional functionality in that the related SACUs (500) can control two missiles arranged in a configuration which is not side-by-side but are vertically stacked or in any other configuration. In an embodiment, if can also allow for more than two missiles (including three, four, or more) to be interlinked together to provide for larger launch systems so long as an appropriate circuit board (or boards) was provided in the resultant array of SACUs (500). Previously, and as indicated above, vehicle mounted launchers (100) would typically include two cradles (101) and (102) arranged side-by-side which allowed for two missile tubes to be mounted. This is as shown in FIG. 1, for example. In many situations, this double cradle arrangement is desired to be preserved but to operate with two SACUs (500) of the present disclosure to provide for improved functionality to existing systems. As was indicated in conjunction with FIGS. 2 and 3, DACU devices typically arm both missiles simultaneously and can only work on missile in fixed relations, co-planar tubes. DACUs, thus, lack the control of the interlinked SACUs which can operate on many more types of missile arrangements.

FIGS. 11-13 show exemplary parent/child configurations which allow for two SACUs (1500) and (2500) to replace a single DACU (200) of prior configuration or to operate together on other missile arrangements. In the depicted embodiment, the SACUs (1500) and (2500) behave as if they are one unit and act in a similar manner to the DACU (200) of FIG. 2. For ease of integration, the parent SACU (1500) utilizes a control circuit board (CCA) (1571) which may actually be the circuit board from a DACU (200) of FIG. 2 (although it is not depicted in FIG. 2 for clarity). In this arrangement, the two SACUs (1500) and (2500) provide for electrical connectivity of the legacy CCA (1571) to both SACUs (1500) and (2500).

In the depicted arrangement, the CCA (1571) is located in the parent SACU (1500) and connected to the vehicle's control system via the input (1577) which connects in the standard fashion to the vehicle TAS (e.g. the VCU). A first portion of the CCA (1576) is connected via the cable (1577) to the umbilical connector (1723) in the first SACU (1500). The CCA (1571), however, has a second portion (1578) which is connected via the cable (1579) to an output (1581). This is connected to a splice cable (1583) connected to the connector (2581) which interconnects to cable (2577) connected to the umbilical connector (2723) in the child SACU (2500).

Note that the child SACU (2500) does not include a circuit board for control as the control of the second tube is via the portion (1578) of the CCA (1571) in the parent SACU (1500). This allows for the system to provide legacy or conventional-type controls for a dual tube configuration as the same, or a similar, CCA (1571) can actually be used to control the two SACU units (1500) and (2500) as would have control the DACU (200). However, the interconnected SACUs (1500) and (2500) can operate on cradles that are not co-planar and need not even be parallel while still utilizing an unmodified CCA (1571) from an original DACU (200). In this arrangement, typically, the SAFE versus ARM mode limit switches (1801) and (1803), and (2801) and (2803) of both units (1500) and (2500) are wired or controlled in series so that both units (1500) and (2500) responds to one arming command to arm both units and communicates that mode only when both units are armed (and vice versa for disarming). However, this is by no means required and alternative embodiments are not wired together.

While use of an unmodified CCA (1578) allows the parent/child SACU (1500) and (2500) configuration to duplicate operation of a DACU (200) (even including potential downsides associated with that CCA (1578)), with an upgraded CCA (1571), the two motorized SACU assemblies (1500) and (2500) can be provided with a variety of additional features and modes of operation. For example, the two SACUs (1500) and (2500) could be controlled completely independently of each other. Further, control can be divided between the two SACU units (1500) and (2500) in a still further embodiment.

In this and other envisioned configurations, the single CCA (1571) may control both motors (1535) and (2535) for the SACUs (1500) and (2500) simultaneously, although this can be tailored to operations for a given platform. Attachment and relative locational positioning of the parent/child units (1500) and (2500) can also be modified, as necessary for space restrictions or the like. In these and other embodiments, the motors (1535) and (2535) for the SACUs (1500) and (2500) would typically be wired in parallel so as to ensure that appropriate voltage is applied to both simultaneously during the control thereof. Amongst various advantages, this allows for the standard operation of the motors (1535) and (2535) without any diminishing of performance characteristics or the like.

It should be noted that the parent/child relationship is not the only relationship and in alternative embodiments, each SACU (1500) and (2500) may act independently or with similar levels of control. In still further embodiments, more than two SACUs (500) may be connected together. This can allow for a single parent to control multiple children, for example, or multiple parents could act independently each controlling some number of children. This allows for a wide variety of different arming arrangements for different cradle and missile configurations and makes the system more modular. Still further, it should be recognized that since each SACU (1500) and (2500) may include its own safety arm (1561) or (2561) the SACU can operate on launchers that each include a single cradle and the associated release arm. This is a new configuration that the DACU cannot operate on. Should the child safety arm (2561) be unnecessary (e.g. when the configuration of FIG. 11 is operating on the launcher (100) of FIG. 1) the child safety arm (2561) or pin (2563) could simply be removed (e.g. as shown in FIG. 8). To act on the launcher (100) of FIG. 1, the housings (1501) and (2501) of the two SACU units (1500) and (2500) may be sized and shaped to occupy a similar footprint to the DACU (200).

While the invention has been disclosed in conjunction with a description of certain embodiments, including those that are currently believed to be the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

It will further be understood that any of the ranges, values, properties, or characteristics given for any single component of the present disclosure can be used interchangeably with any ranges, values, properties, or characteristics given for any of the other components of the disclosure, where compatible, to form an embodiment having defined values for each of the components, as given herein throughout. Further, ranges provided for a genus or a category can also be applied to species within the genus or members of the category unless otherwise noted.

Finally, the qualifier "generally," and similar qualifiers as used in the present case, would be understood by one of ordinary skill in the art to accommodate recognizable attempts to conform a device to the qualified term, which may nevertheless fall short of doing so. This is because terms such as "rectangular" are purely geometric constructs and no real-world component is a true "rectangular" in the geometric sense. Variations from geometric and mathematical descriptions are unavoidable due to, among other things, manufacturing tolerances resulting in shape variations, defects and imperfections, non-uniform thermal expansion, and natural wear. Moreover, there exists for every object a level of magnification at which geometric and mathematical descriptors fail due to the nature of matter. One of ordinary skill would thus understand the term "generally" and relationships contemplated herein regardless of the inclusion of such qualifiers to include a range of variations from the literal geometric or other meaning of the term in view of these and other considerations.

The invention claimed is:

1. A Single Arming Control Unit (SACU) for a missile cradle, the SACU comprising:
- a housing;
- a motor in said housing; and
- a crankshaft in said housing including at least two cranks, wherein:
  - a first crank of said at least two cranks is arranged in a first plane through an axis of rotation of said crankshaft;
  - a second crank of said at least two cranks is arranged in a second plane through said axis of rotation of said crankshaft;
  - said first crank is connected to an interlock pin for a missile tube in said missile cradle;
  - said second crank is connected to an umbilical connector for said missile tube in said missile cradle; and
  - said second plane and first plane are not parallel;
  - wherein, said motor acts to rotate said crankshaft between a first safe position and a second armed position.

2. The SACU of claim 1, further comprising:
- a safety arm and a safety pin;
- wherein when said motor rotates said crankshaft from said safe position to said armed position said motor also causes said safety arm to extend said safety pin from said housing.

3. The SACU of claim 2, wherein a rotor of said motor is arranged generally parallel with said axis of said crankshaft.

4. The SACU of claim 3, wherein said rotor of said motor is arranged generally parallel with said safety arm.

5. The SACU of claim 4, wherein said rotor of said motor is arranged generally parallel to said missile tube.

6. The SACU of claim 1, wherein said first plane is positioned relative said second plane so that said interlock pin extends from said housing before said umbilical connector extends from said housing when said crankshaft rotates from said first safe position to said second armed position.

7. The SACU of claim 1, wherein said missile tube includes a TOW missile.

8. The SACU of claim 1, wherein said missile cradle is arranged generally parallel to a second missile cradle.

9. The SACU of claim 8, wherein said missile cradle is arranged generally coplanar to said second missile cradle.

10. The SACU of claim 1, wherein a rotor of said motor is arranged generally parallel with said axis of said crankshaft.

11. The SACU of claim 10, wherein said rotor of said motor is arranged generally parallel to said missile tube.

12. The SACU of claim 1, further comprising:
- a circuit board electrically interconnected to said umbilical connector for sending signals to said missile tube; and
- a connector for electrically interconnecting said circuit board to a Vehicle Control Unit (VCU) so said circuit board receives signals from said VCU.

13. The SACU of claim 12, wherein said circuit board includes a portion for sending signals to a splice cable electrically interconnected with a second umbilical connector.

14. An arming system for multiple missile tubes, the arming system comprising:
- a first Single Arming Control Unit (SACU) for a first missile cradle, the first SACU comprising:
  - a first housing;
  - a circuit board in said first housing;
  - a first motor in said first housing; and
  - a first crankshaft in said first housing including at least two cranks, wherein:
    - a first crank of said at least two cranks is arranged in a first plane through an axis of rotation of said first crankshaft;
    - a second crank of said at least two cranks is arranged in a second plane through said axis of rotation of said first crankshaft;
    - said first crank is connected to an interlock pin for a first missile tube in said first missile cradle;
    - said second crank is connected to an umbilical connector for said first missile tube in said first missile cradle; and
    - said second plane and first plane are not parallel;
  - wherein, said first motor acts to rotate said first crankshaft between a first safe position and a second armed position; and a second SACU for a second missile cradle, the second SACU comprising:

a second housing;

a second motor in said second housing; and a second crankshaft in said second housing including at least two cranks, wherein:

a first crank of said at least two cranks is arranged in a first plane through an axis of rotation of said second crankshaft;

a second crank of said at least two cranks is arranged in a second plane through said axis of rotation of said second crankshaft;

said first crank is connected to an interlock pin for a second missile tube in said second missile cradle;

said second crank is connected to an umbilical connector for said second missile tube in said second missile cradle; and said second plane and first plane are not parallel;

wherein, said second motor acts to rotate said second crankshaft between a first safe position and a second armed position;

wherein said circuit board electrically controls both said first motor and said second motor.

15. The arming system of claim 14, wherein a rotor of said first motor is arranged generally parallel with said axis of said first crankshaft.

16. The arming system of claim 14, further comprising:

a first safety arm and a first safety pin;

wherein when said first motor rotates said first crankshaft from said safe position to said armed position said first motor also causes said first safety arm to extend said first safety pin from said first housing.

17. The arming system of claim 16, further comprising:

a second safety arm and a second safety pin;

wherein when said second motor rotates said second crankshaft from said safe position to said armed position said second motor also causes said second safety arm to extend said second safety pin from said second housing.

18. The arming system of claim 14, wherein said first motor and said second motor move in tandem.

19. The arming system of claim 14, wherein in both said first SACU and said second SACU said first plane is positioned relative said second plane so that said interlock pin extends from said housing before said umbilical connector extends from said housing when said crankshaft rotates from said first safe position to said second armed position.

20. The SACU of claim 14, wherein said missile cradle is arranged generally coplanar to said second missile cradle.

* * * * *